US009045150B2

(12) United States Patent
Li et al.

(10) Patent No.: US 9,045,150 B2
(45) Date of Patent: Jun. 2, 2015

(54) UNDER-FLOOR LIFTING JACK FOR HIGH-SPEED ELECTRIC MULTIPLE UNIT TRAINSET

(75) Inventors: Yinghao Li, Beijing (CN); Guangdan Liu, Beijing (CN); Guizhong Yu, Beijing (CN); Anshu Lv, Beijing (CN); Yanlin Li, Beijing (CN); Zhigang Wei, Beijing (CN); Sha Li, Beijing (CN); Shushen Zhang, Beijing (CN); Ranggao Xie, Beijing (CN)

(73) Assignee: BEIJING RAILWAY INSTITUTE OF MECHANICAL & ELECTRICAL ENGINEERING CO. LTD, Beijing (CN)

( * ) Notice: Subject to any disclaimer, the term of this patent is extended or adjusted under 35 U.S.C. 154(b) by 1024 days.

(21) Appl. No.: 13/139,288

(22) PCT Filed: Aug. 19, 2010

(86) PCT No.: PCT/CN2010/076156

§ 371 (c)(1),
(2), (4) Date: Jun. 10, 2011

(87) PCT Pub. No.: WO2011/153733

PCT Pub. Date: Dec. 15, 2011

(65) Prior Publication Data

US 2012/0025158 A1 Feb. 2, 2012

(51) Int. Cl.
*B61K 5/04* (2006.01)
*B66F 7/24* (2006.01)
(Continued)

(52) U.S. Cl.
CPC . *B61K 5/04* (2013.01); *B66F 7/243* (2013.01); *B66F 7/0641* (2013.01); *E02B 17/0818* (2013.01)

(58) Field of Classification Search
USPC ..... 254/89 R
See application file for complete search history.

(56) References Cited

U.S. PATENT DOCUMENTS 637,843 A * 11/1899 Zetter ..... 254/43
3,061,044 A * 10/1962 Shotmeyer ..... 187/215

(Continued)

FOREIGN PATENT DOCUMENTS

CN 2918372 7/2007
CN 201086718 7/2008

(Continued)

OTHER PUBLICATIONS

PCT International Search Report dated Mar. 4, 2011, PCT Application No. PCT/CN2010/076156.

(Continued)

*Primary Examiner* — Lee D Wilson
*Assistant Examiner* — Alvin Grant
(74) *Attorney, Agent, or Firm* — Vierra Magen Marcus LLP

(57) ABSTRACT

The invention discloses an under-floor lifting jack for high-speed EMU train, comprising: a main control electric part for controlling the jack, multiple bogie lifting means arranged in pits, fixed rails on the ground between adjacent pits, and body hoists movable along dedicated rails on both sides of the bogie lifting means, wherein lifting rails of the bogie lifting means and the fixed rails form continuous rails, and one or more of the bogie lifting means are set in each pit and adapted for lifting individually or synchronously in combination according to the wheel positions of different types of electric multiple unit trains under the control of the main control electric part. The invention is compatible with the maintenance of various EMU trains, thus the same lifting jack can satisfy maintenance requirements of various EMU trains, resulting in high compatibility and construction cost-reduction of the maintenance base for the EMU train.

15 Claims, 3 Drawing Sheets

(51) Int. Cl.
*B66F 7/06* (2006.01)
*E02B 17/08* (2006.01)

(56) References Cited

U.S. PATENT DOCUMENTS

| | | | | | |
|---|---|---|---|---|---|
| 3,866,542 | A * | 2/1975 | Blunden | 410/8 |
| 3,970,171 | A * | 7/1976 | Honecker et al. | 187/234 |
| 4,091,578 | A * | 5/1978 | Panetti | 451/347 |
| 4,372,537 | A * | 2/1983 | Dur | 266/45 |
| 4,417,466 | A * | 11/1983 | Panetti | 73/105 |
| 4,779,384 | A * | 10/1988 | Shoenhair et al. | 451/347 |
| 4,781,516 | A * | 11/1988 | Cripe et al. | 414/555 |
| 4,817,536 | A * | 4/1989 | Cripe et al. | 105/182.1 |
| 4,829,723 | A * | 5/1989 | Bull et al. | 451/347 |
| 4,830,336 | A * | 5/1989 | Herabakka | 254/95 |
| 4,842,302 | A * | 6/1989 | Lauronen et al. | 280/86.5 |
| 4,920,701 | A * | 5/1990 | Panetti | 451/5 |
| 4,938,151 | A * | 7/1990 | Viens | 105/4.3 |
| 4,942,828 | A * | 7/1990 | Walz et al. | 108/55.5 |
| 5,086,591 | A * | 2/1992 | Panetti | 451/5 |
| 5,133,531 | A * | 7/1992 | Grashoff et al. | 254/89 H |
| 5,404,968 | A * | 4/1995 | Fletcher | 187/205 |
| 5,501,296 | A * | 3/1996 | Fletcher | 187/210 |
| 5,518,220 | A * | 5/1996 | Bertrand et al. | 254/7 B |
| 5,573,083 | A * | 11/1996 | Fletcher et al. | 187/205 |
| 5,636,705 | A * | 6/1997 | St-Germain | 182/141 |
| 5,826,517 | A * | 10/1998 | Larson et al. | 105/4.3 |
| 5,860,491 | A * | 1/1999 | Fletcher | 187/203 |
| 5,876,018 | A * | 3/1999 | Crisp et al. | 254/33 |
| 5,913,559 | A * | 6/1999 | Sexton et al. | 296/20 |
| 6,003,885 | A * | 12/1999 | Richardson | 280/86.5 |
| 6,422,349 | B1 * | 7/2002 | Veletovac | 187/272 |
| 6,460,468 | B1 * | 10/2002 | Mobley | 105/4.2 |
| 6,477,960 | B2 * | 11/2002 | Theurer et al. | 104/9 |
| 6,675,719 | B1 * | 1/2004 | Feider et al. | 104/32.1 |
| 6,679,184 | B1 * | 1/2004 | Rajaram | 104/89 |
| 6,705,595 | B2 * | 3/2004 | Belley et al. | 254/89 H |
| 7,028,987 | B2 * | 4/2006 | Wanner | 254/93 L |
| 7,219,768 | B2 * | 5/2007 | Climenhaga | 187/207 |
| 7,281,608 | B2 * | 10/2007 | Hansl et al. | 187/226 |
| 7,648,320 | B2 * | 1/2010 | Valli | 414/254 |
| 7,895,950 | B2 * | 3/2011 | Green et al. | 104/2 |
| 7,942,244 | B2 * | 5/2011 | Lombard | 182/141 |
| 8,028,973 | B2 * | 10/2011 | Ford et al. | 254/89 R |
| 8,671,627 | B2 * | 3/2014 | Marshall | 52/125.1 |
| 8,700,191 | B2 * | 4/2014 | Marsh et al. | 700/60 |
| 8,708,107 | B2 * | 4/2014 | Finkbeiner | 187/393 |
| 2003/0205162 | A1 * | 11/2003 | Herzog et al. | 104/2 |
| 2004/0016358 | A1 * | 1/2004 | Rajaram | 104/89 |
| 2004/0216957 | A1 * | 11/2004 | Hansl et al. | 187/247 |
| 2012/0114423 | A1 * | 5/2012 | Zago et al. | 405/230 |

FOREIGN PATENT DOCUMENTS

| | | | | |
|---|---|---|---|---|
| CN | 201132555 | | 10/2008 | |
| CN | 201659985 | | 12/2010 | |
| DE | 4134041 | C1 * | 11/1992 | B61K 5/00 |
| DE | 4209664 | A1 * | 9/1993 | B61K 5/04 |
| DE | 202006010225 | | 8/2006 | |
| DE | 102006030432 | B3 * | 8/2007 | |
| EP | 1721804 | A1 * | 11/2006 | B61K 5/04 |

OTHER PUBLICATIONS

English Abstract of CN2918372 published Jul. 4, 2007, 1 page.
English Abstract of CN201659985 published Dec. 1, 2010, 2 pages.
English Abstract of CN201132555 published Oct. 15, 2008, 2 pages.
English Abstract of CN201086718 published Jul. 16, 2008, 1 page.
English Abstract of DE202006010225 published Aug. 31, 2006, 1 page.

* cited by examiner

UNDER-FLOOR LIFTING JACK FOR HIGH-SPEED ELECTRIC MULTIPLE UNIT TRAINSET

CROSS REFERENCE TO RELATED APPLICATIONS

This application is a U.S. national stage filing of International Application No. PCT/CN2010/076156, filed Aug. 19, 2010, claiming priority from Chinese Application No. 201010197810.2, filed Jun. 11, 2010, which are both incorporated herein by reference in their entirety.

FIELD OF THE INVENTION

The present invention relates to repair and maintenance equipment for railway vehicles and locomotives, in particular to an under-floor lifting jack (UFLJ) applicable to various types of electric multiple unit (EMU) trains and the repair & maintenance of the whole EMU train.

BACKGROUND OF THE INVENTION

To guarantee the safety of an EMU train during its practical travelling, bogies (i.e. travel units) of the EMU train are required to be replaced and maintained at certain intervals. Thus, it is necessary to lift the whole train to a proper height to take off the bogies. For this purpose, a lifting jack is necessary.

An under-floor lifting jack consists of bogie lifting means with lifting rails arranged in several spaced pits and body hoists arranged at both sides of the bogie lifting means. Fixed rails arranged on the ground between adjacent pits and the lifting rails of the bogie lifting means form a continuous track on which the EMU train and the bogies may travel. The EMU train usually consists of a basic unit of 8 cars, and each of the cars has two bogies. The bogie lifting means can lift the whole train and the bogies together to a proper height. After the lifting, the body hoists lift and maintain the car bodies at the height, and then the bogies are disconnected from the car bodies and lowered along with the bogie lifting means, and separated from the car bodies.

The UFLJ is indispensable equipment for the repair and maintenance of the EMU train, and can be used to change all bogies of a whole EMU train without uncoupling the train or to repair and maintain any single bogie of a car after the train is uncoupled. The prevalent EMU train in China usually consists of a basic unit of 8 cars including two locomotives and 6 intermediate cars. In practice, two basic 8-cars units can be linked to form a 16-cars EMU train, which, however, is always uncoupled into two basic units for repair and maintenance. In China, the four types of EMU trains, i.e. CRH1, CRH2, CRH3 and CRH5, production of which began in 2007, have become the main high-speed railway passenger trains. Since such four types of EMU trains are different from each other in dimensions such as the total length, locomotive length, intermediate-car length, the tread (i.e. the distance between two wheels of a wheel-set), the fixed distance (i.e. a distance between centers of two bogies of a car) and the car width (as shown in Table 1 below). For any existing UFLJ in the world, both the distances between adjacent pits and lengths of the bogie lifting means are the same and correspond to the lengths of the respective type of train. As a result, each of the UFLJs only matches one type of EMU train. Therefore, the existing UFLJs all over the world are not compatible with all the four types of EMU trains.

Due to the tight-lock type coupler between cars of the EMU train, the permitted height tolerance between cars during the lifting process in repair & maintenance is strictly confined to ±4 mm, which requires the UFLJ to be equipped with an accurate positioning function and a synchronous lifting & lowering function. A concentrated repair and maintenance mode is adopted for the EMU trains in maintenance bases (e.g. an EMU depot) in China. Each of the maintenance bases is built for several or all types of EMU trains. If one type of UFLJ is designed for a single type of EMU train, a great waste would occur for the construction of the EMU train maintenance bases. Thus, the compatibility of the UFLJ is essential.

SUMMARY OF THE INVENTION

The invention aims to provide an under-floor lifting jack compatible with various types of EMU trains, so that the repair and maintenance of different types of EMU trains can be implemented with one UFLJ.

The technology solution of the invention is described as follows.

There is provided an under-floor lifting jack for high-speed electric multiple unit train, comprising: a main electric control part for controlling the under-floor lifting jack, multiple bogie lifting means arranged in pits, fixed rails on the ground between adjacent pits, and body hoists movable along dedicated rails on both sides of the bogie lifting means, wherein lifting rails of the bogie lifting means and the fixed rails form continuous rails, and one or more of the bogie lifting means are set in each of the pits and adapted for lifting individually or synchronously in combination according to the wheel positions of different types of electric multiple unit trains under the control of the main electric control part.

Preferably, the pits and the bogie lifting means are arranged longitudinally with respect to a midpoint of the electric multiple unit train symmetrically. At one side of the midpoint, a first bogie lifting means is mounted in a first pit; a second bogie lifting means is mounted in a second pit which is separated from the first pit by first fixed rails; a third bogie

TABLE 1

| | Geometry Parameter | | | | | | |
|---|---|---|---|---|---|---|---|
| | Length (mm) | | | | Fixed | Car | Wheel |
| Type | Trainset | Locomotive | Intermediate Car | Tread (mm) | Distance (mm) | Width (mm) | Diameter (mm) |
| CRH1 | 214000 | 26950 | 26600 | 2700 | 19000 | 3331 | 915 |
| CRH2 | 201400 | 25700 | 25000 | 2500 | 17500 | 3380 | 860 |
| CRH3 | 200685 | 25675 | 24775 | 2500 | 17375 | 3265 | 920 |
| CRH5 | 215000 | 27600 | 27500 | 2700 | 19000 | 3200 | 890 |

lifting means is mounted in a third pit which is separated from the second pit by second fixed rails; fourth, fifth and sixth bogie lifting means are mounted in a fourth pit which is separated from the third pit by third fixed rails; seventh, eighth and ninth bogie lifting means are mounted in a fifth pit which is separated from the fourth pit by fourth fixed rails; tenth and eleventh bogie lifting means are mounted in a sixth pit which is separated from the fifth pit by fifth fixed rails, and short fixed rails are arranged between the two first pits at both sides of the midpoint.

Preferably, a length of the first bogie lifting means is 3700 mm; lengths of the second and the third bogie lifting means are both 4750 mm; lengths of the fourth and the fifth bogie lifting means are both 4600 mm; a length of the sixth bogie lifting means is 3700 mm; lengths of the seventh, eighth and ninth bogie lifting means are each 4600 mm; lengths of the tenth and eleventh bogie lifting means are both 4000 mm; a length of the first fixed rails is 13815 mm; a length of the second fixed rails is 2070 mm; a length of the third fixed rails is 11930 mm; a length of the fourth fixed rails is 10555 mm; a length of the fifth fixed rails is 8785 mm; a length of the short fixed rails is 3430 mm.

Preferably, a laser distance-measuring device composed of a laser range finder and a data display screen is installed on a telescopic device on one side of an end of the continuous rails and adapted to measure a position error in stopping the electric multiple unit train, the output of the laser range finder is connected to the main electric control part.

Preferably, a driving wheel driven by a motor is equipped under the body hoist.

Preferably, a supporting head of the body hoist is equipped with a transverse displacement device.

Preferably, the motor which drives the supporting head up and down is an asynchronous AC motor driven by a transducer, and an encoder is arranged on the shaft of the AC motor.

Preferably, a location-sensing slice is installed at the initial longitudinal position of the body hoist and a sensor corresponding to the location-sensing slice is installed on the body hoist.

In view of the fact that the existing UFLJ is applicable to only one type of EMU train, the present invention is proposed to achieve that one type of UFLJ may be applicable to various types of EMU trains, e.g. the existing four types of CRHs in China, and the invention is advantageous in that: (1) the UFLJ is symmetrically aligned with respect to the midpoint of the EMU train longitudinally, thus reducing the position errors of respective bogies of various EMU trains by one half; (2) four lengths for the bogie lifting means enable the bogies different from each other slightly in position to be lifted by the same bogie lifting means; (3) the quantity of the bogie lifting means is increased for lifting bogies different from each other significantly in position. Theoretically, an 8-car-unit EMU train is equipped with 16 bogies, and thus 16 bogie lifting means should be enough for lifting the EMU train. However, 22 bogie lifting means are provided in the present invention, that is, the quantity of the bogie lifting means is more than that of the bogies. Owning to the above three optimum technologies, the inventive UFLJ is the most reasonable, feasible and simplest equipment to realize the compatibility for repair & maintenance of various types of EMU trains.

BRIEF DESCRIPTION OF THE DRAWINGS

The detailed explanation of the present invention is provided below according to the accompanying drawings and embodiments.

DETAILED DESCRIPTION OF THE EMBODIMENTS

As shown in FIGS. 1-6, according to an embodiment of the invention, a main electrical control part controlling a lifting jack is included. The main electric control part mainly controls the up and down movements of the bogie lifting means, as well as travelling, up and down movements and transverse movements of body hoists. Multiple pits separate from each other are arranged longitudinally. Fixed rails are set on the ground between adjacent pits. Lifting rails 1-11 of the bogie lifting means in the pits and the fixed rails 12-17 set on the ground between pits may form standard continuous rails on which the EMU trains can travel. One or more bogie lifting means are set in each pit. Under the control of the main electric control part, the bogie lifting means can lift individually or synchronously in group according to wheel positions of different EMU trains. Multiple body hoists 18 which are movable along dedicated rails 20 are arranged at both sides of the bogie lifting means in the pits.

When an EMU train is driven onto the bogie lifting means along the standard continuous rails and stops at the appointed position, the bogie lifting means in several pits may lift the whole EMU train synchronously to a specified height. The lifting jack can also lift any single car after the EMU train is uncoupled. Under the instruction of the main electric control part, the body hoists 18 move lengthwise along with the rails to precisely align with the lifting points of the EMU train and lift the cars to a specified height, so that the bogies may be separated from the cars for repair and maintenance. Preferably, the bogie lifting means are arranged symmetrically with respect to the longitudinal midpoint of the EMU train, thus, the position error of the respective bogies of different types of EMU trains on the lifting jack is reduced by half.

Figure 1:
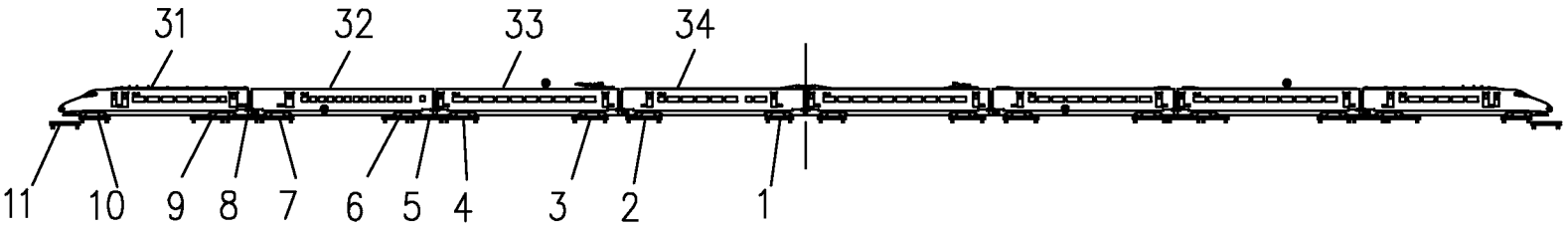
FIG. 1 is a schematic structural diagram showing the bogie lifting means according to an embodiment of the invention, with an EMU train being on the bogie lifting means.
Figure 2:
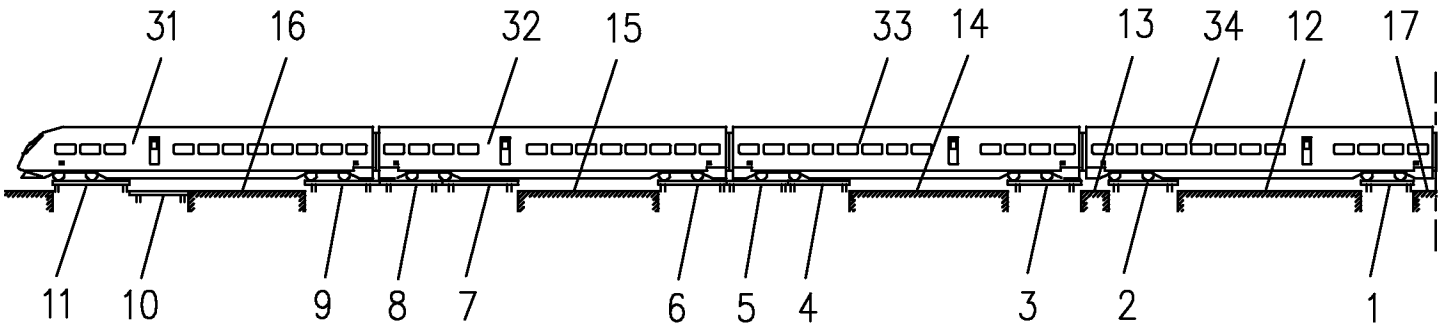
FIG. 2 is a schematic structural diagram showing the arrangement of the left half of the EMU train of the CRH1 type on the bogie lifting means.
Figure 3:
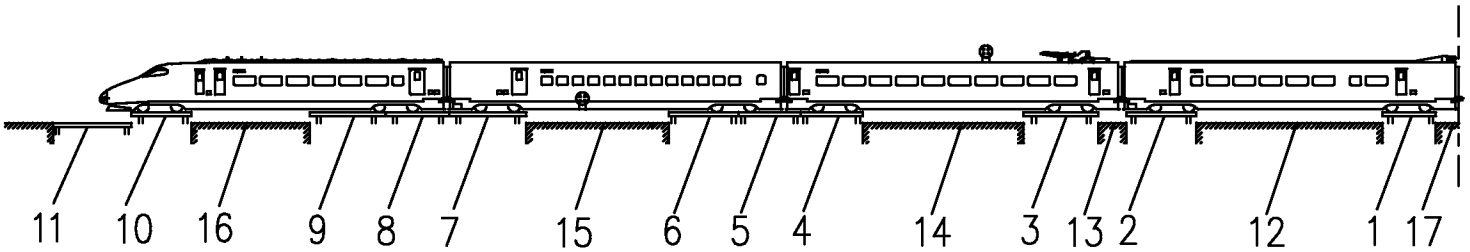
FIG. 3 is a schematic structural diagram showing the arrangement of the left half of the EMU train of the CRH2 type on the bogie lifting means.
Figure 4:
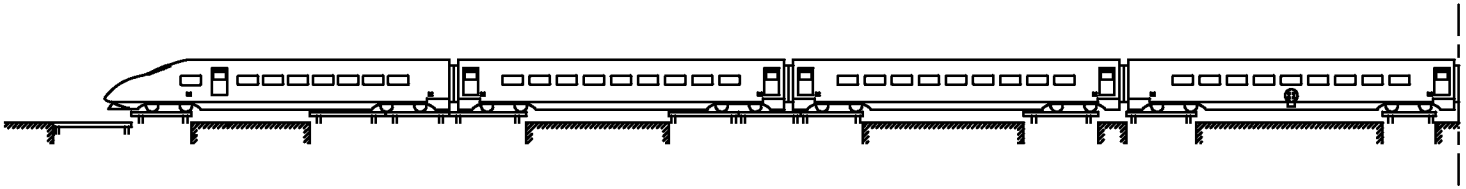
FIG. 4 is a schematic structural diagram showing the arrangement of the left half of the EMU train of the CRH3 type on the bogie lifting means.
Figure 5:
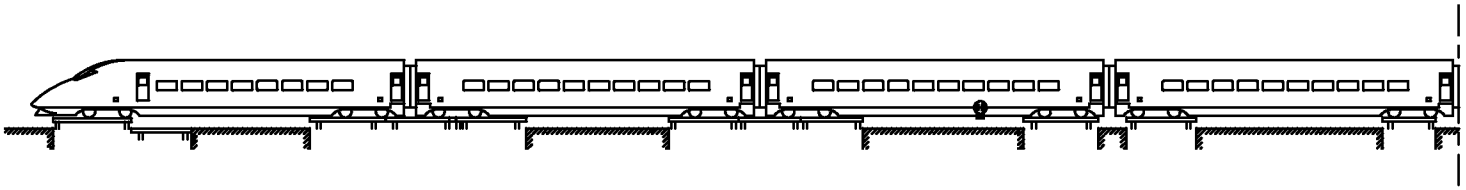
FIG. 5 is a schematic structural diagram showing the arrangement of the left half of the EMU train of the CRH5 type on the bogie lifting means.

As shown in FIGS. 2-3, on the left side of the midpoint of the EMU train, a first bogie lifting means 1 is mounted in a first pit; a second bogie lifting means 2 is mounted in a second pit which is separated from the first pit by first fixed rails 12; a third bogie lifting means 3 is mounted in a third pit which is separated from the second pit by second fixed rails 13; fourth, fifth and sixth bogie lifting means 4, 5 and 6 are mounted in a fourth pit which is separated from the third pit by third fixed rails; seventh, eighth and ninth bogie lifting means 7, 8 and 9 are mounted in a fifth pit which is separated from the fourth pit by fourth fixed rails 15; tenth and eleventh bogie lifting means 10 and 11 are mounted in a sixth pit which is separated from the fifth pit by fifth fixed rails 16. The other 11 bogie lifting means are set symmetrically on the right side of the midpoint. Short fixed rails 17 are set between the two first pits at two sides of the midpoint, and the midpoint of the short fixed rails 17 is at the same position as the midpoint of the arrangement of the under-floor lifting jack. That is, there are 6 pits and 11 bogie lifting means on each side of the midpoint. Each car is lifted by 4 body hoists, and thus there are 32 body hoists in total, with 16 body hoists being arranged on each side of the midpoint.

Preferably, the length of the first bogie lifting means 1 is 3,700 mm; the lengths of the second and third bogie lifting means 2 and 3 are both 4,750 mm; the lengths of the fourth and fifth bogie lifting means 4 and 5 are both 4,600 mm; the length of the sixth bogie lifting means 6 is 3,700 mm; the lengths of the seventh, eighth and ninth bogie lifting means 7, 8 and 9 are each 4,600 mm; and the lengths of the tenth and eleventh bogie lifting means 10 and 11 are both 4,000 mm. The above bogie lifting means with various lengths increase the compatibility. The length of the first fixed rails 12 is 13,815 mm; the length of the second fixed rails 13 is 2,070 mm; the length of the third fixed rails 14 is 11,930 mm; the length of the fourth fixed rails 15 is 10,555 mm; the length of the fifth fixed rails 16 is 8,785 mm; and the length of the short fixed rails 17 is 3,430 mm. The longitudinal midpoint of the short fixed rails 17 is the same as the midpoint of the under-floor lifting jack. In actual operations, bogies of different types of EMU trains are set in different positions on the bogie lifting means. FIGS. 2, 3, 4 and 5 are the schematic structural diagrams showing the arrangement of the left halves of the EMU trains of the CRH1, CRH2, CRH3, and CRH5 on the bogie lifting means. As shown in these Figures, a bogie may be lifted by one single bogie lifting means or by two adjacent bogie lifting means synchronously. Hereinafter, EMU trains of CRH1 and CRH2 are taken as examples to explain the mode of combining the bogie lifting means for lifting. When all bogie lifting means are in the initial non-lift state, the lifting rails 1-11 are aligned and joined with the fixed rails 12-17 to form continuous standard rails, along which the trains can travel onto the under-floor lifting jack. After alignment of the longitudinal midpoint of the EMU train with the midpoint of the short fixed rails 17 by the laser distance-measuring device 23, the bogie lifting means may be operated for lifting. In the case of the EMU train of the type CRH1 (refer to FIG. 2), the bogie lifting means other than the tenth bogie lifting means 10 are all involved in lifting. For example, the front bogie of the locomotive 31 is lifted by the eleventh bogie lifting means 11 and the rear bogie of the locomotive 31 is lifted by the ninth bogie lifting means 9; the front bogie of the first middle-car 32 is lifted by the eighth bogie lifting means 8 and the seventh bogie lifting means 7 together, and the rear bogie of the first middle-car 32 is lifted by the sixth bogie lifting means 6; the front bogie of the second middle-car 33 is lifted by the fifth bogie lifting means 5 and the Fourth bogie lifting means 4 together, and the rear bogie of the second middle-car 33 is lifted by the third bogie lifting means 3; and the front bogie of third middle-car 34 is lifted by the second bogie lifting means 2 and the rear bogie of the third middle-car 34 is lifted by the first bogie lifting means 1.

As shown in FIGS. 2-5, because of the symmetrical alignment of the bogie lifting means with respect to the midpoint of the EMU train, errors of bogies positions are small for the bogies close to the midpoint and getting larger for the bogies far from the midpoint. For the three bogies closest to the midpoint, altering the lengths of bogie lifting means 1-3 can satisfy the compatibility requirements for the different types of EMU trains, so that the EMU trains can be lifted although they are in different lengths. As for the bogies far from the midpoint, in additional to extending the length of the bogie lifting means, additional bogie lifting means may be added in the respective pit. For example, the bogie lifting means 10 and 11 are mounted in the sixth pit, the bogie lifting means 7, 8 and 9 are mounted in the fifth pit, and the bogie lifting means 6, 5 and 4 are mounted in the fourth pit.

Figure 6:
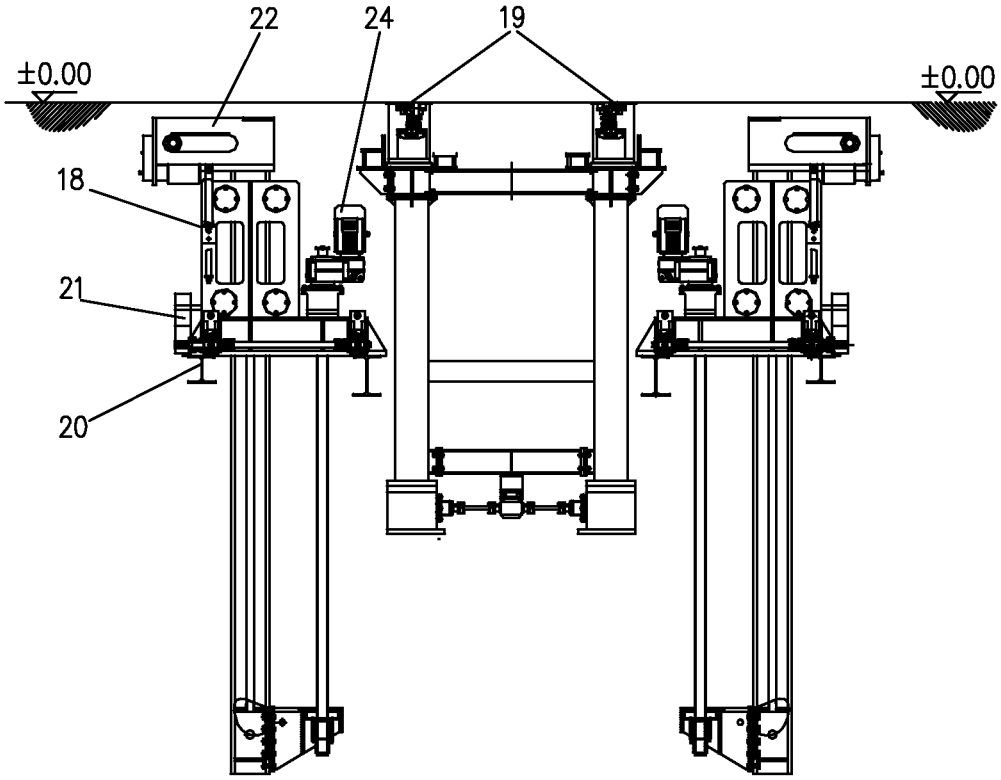
FIG. 6 is a schematic diagram showing the transverse layout of the bogie lifting means and the body hoist in a pit.

Different types of EMU trains are different in length and hence different in positions of car supporting points, thus, the body hoist 18 may be moved longitudinally along the dedicated rails 20 longitudinally through wheels driven by a motor 21 (which is described in another patent application), so that the supporting heads 22 of the body hoists 18 can be aligned with supporting points of the car. Each car of the EMU train may be lifted by 4 body hoists, and thus totally 32 body hoists are needed for lifting the whole train. Due to different car widths of various types of EMU trains, the supporting heads 22 are equipped with transverse displacement device (which is described in another patent application) to adapt to different cars. In the non-lift state, the supporting head 22 returns to its initial position. During the lifting process, the transverse extending distances of the supporting heads 22 are set by the Main Control System according to the different car widths, to align the supporting heads 22 with the supporting points of the car vertically. The supporting head 22 is moved up and down by the control of a transducer-driven asynchronous motor 24 and reducer, as shown in FIG. 6.

Figure 7:
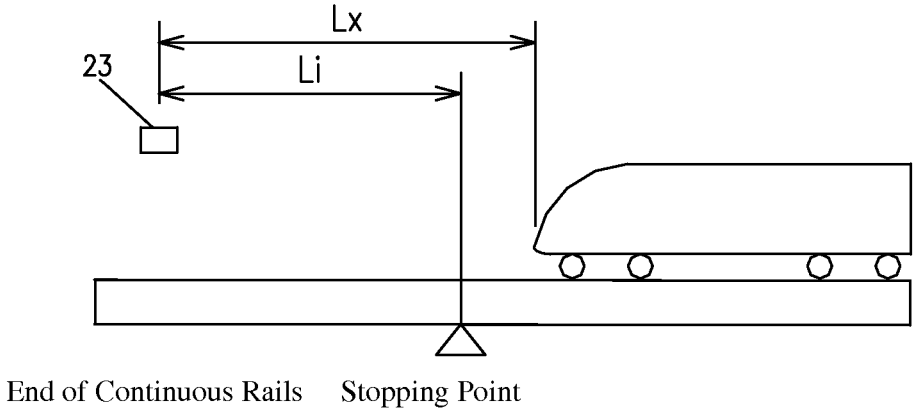
FIG. 7 is a schematic diagram of the laser distance-measuring device.

When the EMU train travels onto the UFLJ, accurate positioning of the EMU train is important, so that the EMU train is placed evenly at both sides of the UFLJ. The existing 4 types of EMU trains in China are longer than 200 m and different in lengths, therefore it is very difficult for the driver to stop the EMU train precisely at the appointed position on the UFLJ. Thus, a laser distance-measuring device 23 including a laser range finder and a Display Screen is installed at one side of the end of the continuous standard rails, as shown in FIG. 7, and a "Stop Position" sign is set as a reference for driver to stop the train. The laser distance-measuring device is installed on a telescopic device so that the laser distance-measuring device can be set above the continuous standard rails before the EMU train travels onto the UFLJ. The distance between the "stop position" sign and the laser distance-measuring device denoted by Li is a given value which varies with the type of EMU trains and is known value. The laser distance-measuring device 23 measures the distance denoted by Lx between itself and the locomotive of the EMU train when the EMU train travels along the rails. The distance Lx is returned in real time to the main electric control part and the display screen. When the difference between the distances Lx and Li is within the range of ±150 mm, i.e. $-150<Lx-Li<150$, the driver can stop the EMU train. Subsequently, the laser distance-measuring device 23 sends the result of the detected position of the stopped EMU train to the main electric control part, so that the body hoists 18 can move along the dedicated rails 20 and align with the car supporting points accordingly. The functions of information feedback and position error compensation of the laser distance-measuring device 23 realize the precise, effective and automatic alignment between the EMU train and the UFLJ.

As described above, the EMU train stops accurately at the appointed position and all bogies of the EMU train are positioned on the bogie lifting means. Then the bogie lifting means lift the whole EMU train to a specified height. As per instructions from the main control part, the body hoists move lengthwise and the supporting heads move crosswise to align with the supporting points of the EMU train. The Support Heads of the body hoists can then lift the car bodies after the alignment and separate the car bodies from the bogies.

Because of the high requirement of synchronization precision of lifting the whole EMU train, the lifting of the supporting head 22 is driven by a transducer-driven asynchronous AC motor 24. An encoder is equipped on the shaft of the asynchronous AC motor 24 to provide a feedback signal of motor speed. Also, the main electric control part sends a predefined speed signal which is passed to the control drivers through a communication bus. A digital PID regulator compares the predefined speed signal and the feedback signal of motor speed to adjust the working frequency of the transducer accordingly, so as to adjust the rotating speed of the AC motor and guarantee the synchronization of the lifting. The control driver may consist essentially of a digital signal processor (DSP), an amplifying circuit, a transducer, a protection circuit and an interface circuit. A sensor is installed on the body hoist 18 and a location-sensing slice is set at the initial position of the body hoist 18. After each completion of lifting of the car body, the body hoists can return to their initial positions through the interaction of the sensing slices and the sensors, thereby ensuring that the body hoist can arrive at an accurate position ready for lifting under the control of the main electrical control part. The lifting synchronization precision which is ≤±1 mm and the lifting speed difference which is ≤±10% during the lifting of the UFLJ both exceed the existing standards.

The above is detailed description of the illustrative embodiments of the present invention. However, these embodiments are not intended to limit the scope of this invention. All equivalent implementations or modifications which do not depart from the technology spirit of the invention, such as different dimensions, a different quantity of bogie lifting means and different embodiments of the control circuits, should be contained in scope of the invention.

The invention claimed is:

1. An under-floor lifting jack for a high-speed electric multiple unit train, comprising: a main electric control part for controlling the under-floor lifting jack, multiple bogie lifting means arranged in pits, fixed rails on the ground between adjacent pits, body hoists (18) movable along dedicated rails (20) on both sides of the bogie lifting means, wherein lifting rails (19) of the bogie lifting means and the fixed rails form continuous rails, and one or more of the bogie lifting means are set in each of the pits and adapted for lifting individually or synchronously in combination according to the wheel positions of different types of electric multiple unit trains under the control of the main electric control part, and a laser distance-measuring device (23), composed of a laser range finder and a data display screen, is installed on a telescopic device on one side of an end of the continuous rails and adapted to measure a position error in stopping the electric multiple unit train, the output of the laser range finder is connected to the main electric control part.

2. The under-floor lifting jack of claim 1, wherein the pits and the bogie lifting means are arranged longitudinally with respect to a midpoint of the electric multiple unit train symmetrically, wherein at one side of the midpoint, a first bogie lifting means (1) is mounted in a first pit; a second bogie lifting means (2) is mounted in a second pit which is separated from the first pit by first fixed rails (12); a third bogie lifting means (3) is mounted in a third pit which is separated from the second pit by second fixed rails (13); fourth, fifth and sixth bogie lifting means (4), (5) and (6) are mounted in a fourth pit which is separated from the third pit by third fixed rails (14); seventh, eighth and ninth bogie lifting means (7), (8) and (9) are mounted in a fifth pit which is separated from the fourth pit by fourth fixed rails (15); tenth and eleventh bogie lifting means (10) and (11) are mounted in a sixth pit which is separated from the fifth pit by fifth fixed rails (16), and short fixed rails (17) are arranged between the two first pits at both sides of the midpoint.

3. The under-floor lifting jack of claim 2, wherein a length of the first bogie lifting means (1) is 3700 mm; lengths of the second and the third bogie lifting means (2) and (3) are both 4750 mm; lengths of the fourth and the fifth bogie lifting means (4) and (5) are both 4600 mm; a length of the sixth bogie lifting means (6) is 3700 mm; lengths of the seventh, eighth and ninth bogie lifting means (7), (8) and (9) are each 4600 mm; lengths of the tenth and eleventh bogie lifting means (10) and (11) are both 4000 mm; a length of the first fixed rails (12) is 13815 mm; a length of the second fixed rails (13) is 2070 mm; a length of the third fixed rails (14) is 11930 mm; a length of the fourth fixed rails (15) is 10555 mm; a length of the fifth fixed rails (16) is 8785 mm; a length of the short fixed rails (17) is 3430 mm.

4. The under-floor lifting jack of claim 1, wherein a driving wheel driven by a motor (21) is equipped under the body hoist (18).

5. The under-floor lifting jack of claim 4, wherein a supporting head (22) of the body hoist (18) is equipped with a transverse displacement device.

6. The under-floor lifting jack of claim 4, wherein the motor (24) which drives the supporting head (22) up and down is an asynchronous AC motor driven by transducer and an encoder is arranged on a shaft of the AC motor.

7. The under-floor lifting jack of claim 6, wherein a location-sensing slice is installed at the initial longitudinal position of the body hoist (18) and a sensor corresponding to the location-sensing slice is installed on the body hoist (18).

8. The under-floor lifting jack of claim 2, wherein a driving wheel driven by a motor (21) is equipped under the body hoist (18).

9. The under-floor lifting jack of claim 3, wherein a driving wheel driven by a motor (21) is equipped under the body hoist (18).

10. The under-floor lifting jack of claim 9, wherein a supporting head (22) of the body hoist (18) is equipped with a transverse displacement device.

11. The under-floor lifting jack of claim 10, wherein the motor (24) which drives the supporting head (22) up and down is an asynchronous AC motor driven by transducer and an encoder is arranged on a shaft of the AC motor.

12. The under-floor lifting jack of claim 9, wherein the motor (24) which drives the supporting head (22) up and down is an asynchronous AC motor driven by transducer and an encoder is arranged on a shaft of the AC motor.

13. The under-floor lifting jack of claim 8, wherein a supporting head (22) of the body hoist (18) is equipped with a transverse displacement device.

14. The under-floor lifting jack of claim 13, wherein the motor (24) which drives the supporting head (22) up and down is an asynchronous AC motor driven by transducer and an encoder is arranged on a shaft of the AC motor.

15. The under-floor lifting jack of claim 8, wherein the motor (24) which drives the supporting head (22) up and down is an asynchronous AC motor driven by transducer and an encoder is arranged on a shaft of the AC motor.

* * * * *